US005771646A

United States Patent [19]

DeSouza

[11] Patent Number: 5,771,646

[45] Date of Patent: Jun. 30, 1998

[54] RAILING POST REINFORCEMENT BRACKET

[76] Inventor: Joseph DeSouza, 10580 Tudor Circle, North Royalton, Ohio 44133

[21] Appl. No.: 869,747

[22] Filed: Jun. 5, 1997

[51] Int. Cl.[6] ..... E04B 1/00

[52] U.S. Cl. ..... 52/263; 52/288.1; 52/715; 403/230; 248/300

[58] Field of Search ..... 52/712, 715, 714, 52/263, 288.1; 248/300, 534; 403/403, 230, 232.1, 231, 234

[56] References Cited

U.S. PATENT DOCUMENTS

| | | | |
|---|---|---|---|
| 3,533,205 | 10/1970 | Pestel et al. | 52/714 X |
| 3,559,356 | 2/1971 | Koral | 52/288.1 X |
| 3,615,110 | 10/1971 | Fugate | 403/230 |
| 4,102,587 | 7/1978 | Herb et al. | 403/231 X |

*Primary Examiner*—Creighton Smith

[57] ABSTRACT

A wood railing assembly is attached to the top of a wood deck having rim joists and top deck boards. The railing has vertical posts and horizontal rails mounting spindles, and all of the posts are notched at the bottom. The corner post is attached by the use of a bracket extending all the way around the bottom end portion of the post with flanges extending on the outer surface of the rim joists. Lag screws extend through the bottom end through the bracket, with some of the lag screws extending through the post end of the joists and other lag screws extending directly into the joists to clamp the bracket in place. The side post uses a bracket assembly having an outer channel having a face and sides that enclose the exposed portion of the bottom end and receive machine screws extending through the plate, the lower end, the joists, and through a backing plate, where suitable nuts are used to clamp the assembly together as a unit.

6 Claims, 3 Drawing Sheets

Fig.2
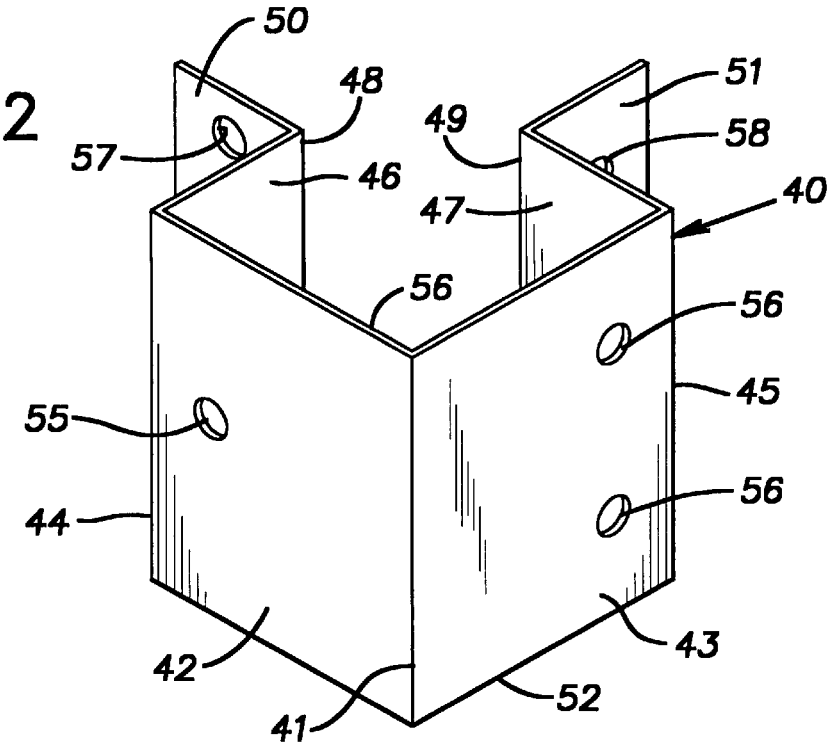
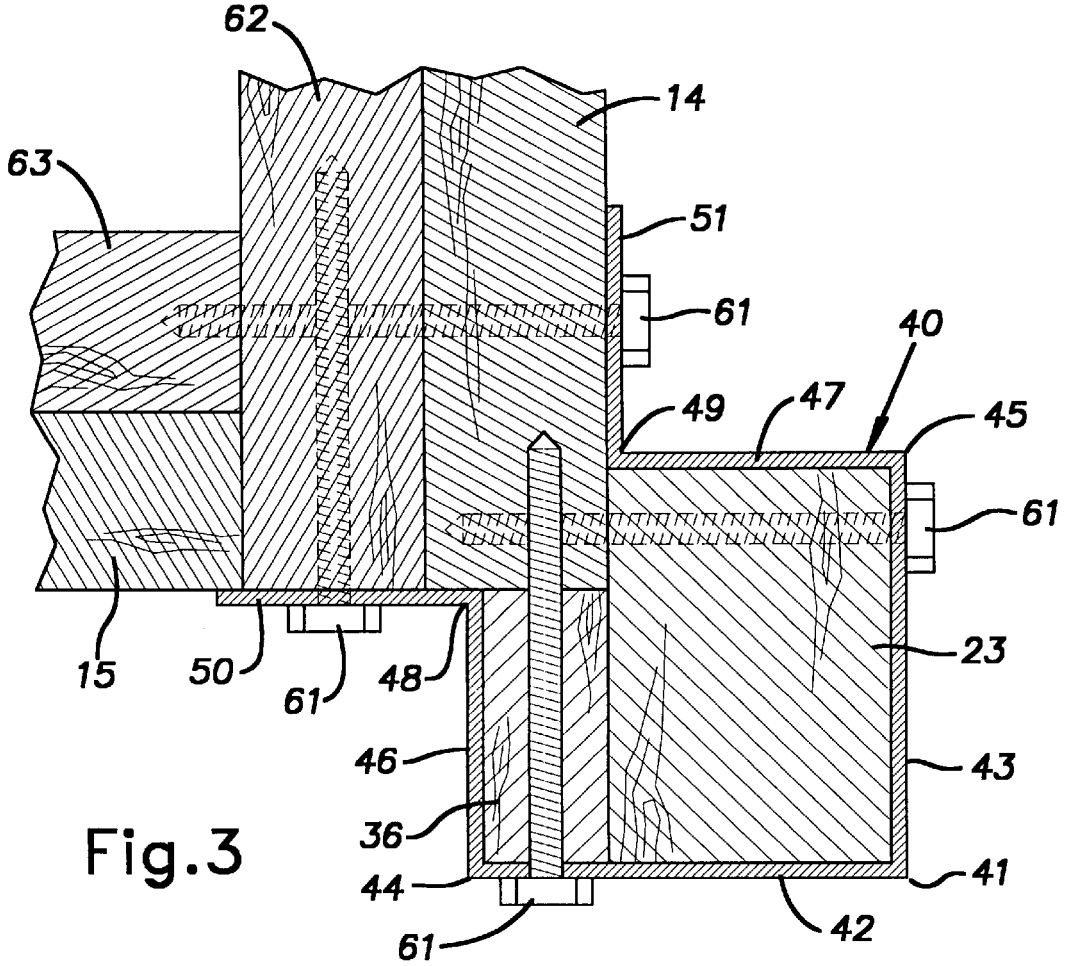
Fig.3

RAILING POST REINFORCEMENT BRACKET

BACKGROUND OF THE INVENTION

This invention relates generally to wood decks and railings and more particularly to structures used to support and anchor railing posts to wood decks such as those of the type used outside houses, and other buildings.

Wood decks have become increasingly popular as an alternative for paved patios both because they offer the esthetic appeal of wood and because they are constructed above the ground level. These decks may be easily attached to the adjacent house and extend outward over a sloping surface to be supported at the outer edge by appropriate support posts which are sunken into the ground.

In a typical construction of such a deck, the posts are first installed in the ground, and a support frame is added by the use of peripheral beams or rim joists which are usually doubled in thickness. The space inside this rim is then completed by installing intervening parallel joists. After this framework is complete, the deck boards are then installed to cover all of the upper surface above the joists and extend to the outer edges of the support frame.

Since decks are usually raised above ground level, it is necessary for safety purposes to install a protective railing around the periphery of the deck. Such railings have generally been made using square posts attached to the deck at spaced intervals, with the posts connected by horizontal upper and lower rails mounting spaced vertical spindles. While recently adopted safety standards have resulted in requiring increased strength of the railings, one of the weakest points of the railing assembly has been the attachment of the posts to the deck. One of the oldest methods has been to abut the bottom of the post directly on the top surface of the deck using either direct nailing or a special bracket which is first mounted and fastened to the deck and then the post is fastened to the bracket. This requires expensive brackets for the necessary strength and requires that the railing be placed a distance inward from the edge, resulting in a loss of useful space.

Another approach has been to merely fasten the post to the outside vertical surface of the rim joists, but this results in the railing being too far out from the edge. Therefore, a more common approach has been to notch the bottoms of the posts so that the top of the notch rests on the top surface of the deck while the side of the notch abuts the side of the deck and the rim joist. Suitable lag screws and washers are then used to fasten the bottom of the post to the rim joist. Where a corner post is required, a standard precut line post as described above is used together with a filler block in a portion of the notch so that the post will be symmetrical at the corner. However, even if extra lag screws are used, the strength of the connection between the post and the deck tends to be below a desirable level, and as a result, the complete railing assembly may not meet the necessary safety standards for impact strength.

SUMMARY OF THE INVENTION

The present invention provides an improved and strengthened mounting arrangement for both the line and corner posts of the railing assembly.

In accordance with the present invention, a metal bracket is provided for use with long lag or machine screws to confine and support the bottom end of both line and corner posts and are formed of sufficiently thick metal that additional washers are not needed, since the bracket itself is engaged by the head of the lag screw to prevent any possibility of the screw head embedding directly in the wood. Furthermore, by surrounding the exposed end of the post with heavy sheet metal, the possibility of splitting or breaking of this end is greatly reduced.

According to the preferred embodiment of the invention for a corner post, the wooden post itself is shaped the same as a line post placed midway along the deck in that the standard square post having actual dimensions of 3½" square, or a nominal 4"×4", has a notch approximately 1¼" deep horizontally and having a vertical distance of about 5½" to 8", depending upon the thickness of the joists and the flooring on which the post is to be installed. A filler block in the notch is used to give a small symmetrical portion of the notch remaining so that the post will be centered with respect to the corner. The end of the post and the notch are then inserted into a bracket which has a vertical extent at least equal to the cut-out notch and which has sides or panels which extend over the outer two sides of the bottom of the post and back along the other two sides a distance up to the remaining notch in its post so that when the post is placed with the notch on top of the deck, the two remaining outwardly-extending flanges will come into abutting contact with the rim joists, and the post and bracket will make a snug fit with the corner of the deck. The bolt holes in the bracket now serve as a template and the screw holes are now drilled. Suitable lag screws are then inserted through the bracket, both through the bracket and directly into the rim joists and at right angles through the filler block and into the rim joists so that these members are thoroughly secured together. Then, additional lag screws or bolts extend through the flanges adjacent the deck rim joists and through at least the double joists to firmly hold the post in place.

When the post is used as a line post without the filler blocks so it abuts the rim joist, a channel-shaped bracket is used to extend over the outer face and back along the sides to a point adjacent the rim joist. Bolts then extend through the bracket, the bottom of the post, and the rim joist to project on the back side where they engage a back plate which preferably has the same dimensions as the face plate of the channel. By then using washers and nuts on the machine bolts, it is possible to thoroughly tighten the assembly to compress the outer bracket against the post, the post against the rim joist, and the back plate against the back of the rim joist. By using a sufficiently thick metal, such as hot rolled steel, it is possible to create a sufficiently strong attachment that it is likely that the post will break above the brackets under side impact before the brackets themselves will be displaced from either the post bottom or the deck joists.

If posts are used with a different cross-sectional shape, such as round, hexagonal or octagonal, the bracket will be formed to match its cross-section with the appropriate shape to surround and contact the surfaces of the base and screws will be positioned accordingly to engage both joists at the corners.

BRIEF DESCRIPTION OF THE DRAWINGS

FIG. 2 is a perspective view of the corner bracket according to the present invention;

FIG. 3 is a fragmentary cross-sectional view taken on line 3—3 of FIG. 1 showing the corner post and bracket assembled to the rim joists;

DETAILED DESCRIPTION OF THE PREFERRED EMBODIMENT

Figure 6:
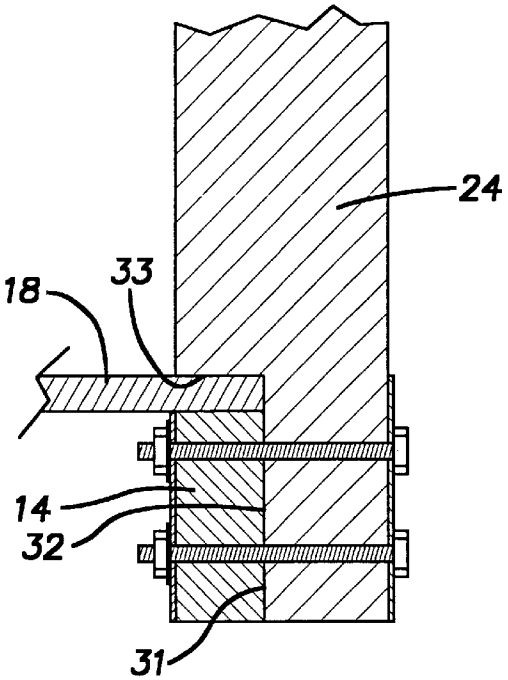
FIG. 6 is a fragmentary vertical cross-sectional view of a line post mounted on the deck.
Figure 1:
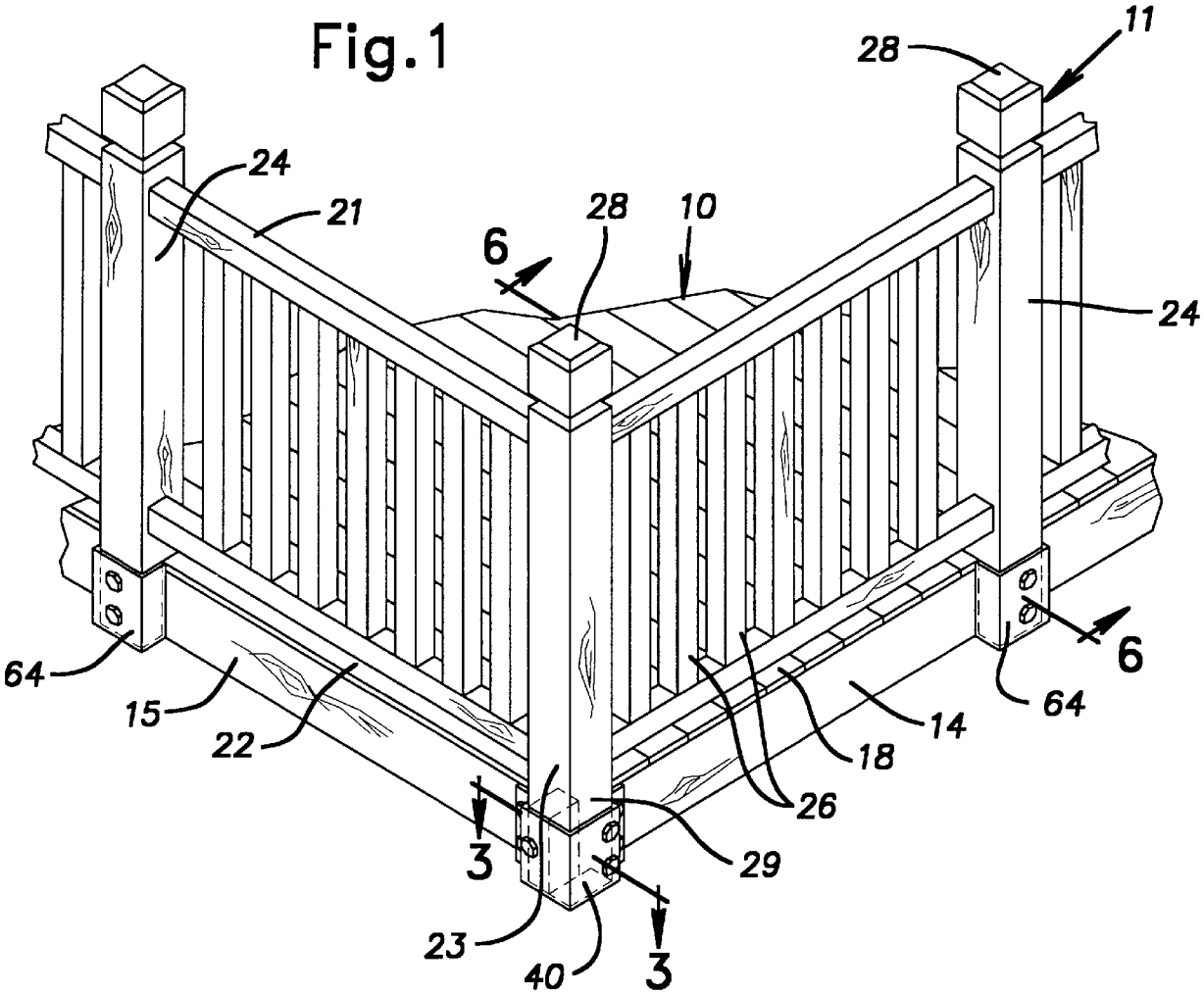
FIG. 1 is a perspective view of a corner portion of a deck and railing incorporating the present invention.

Referring to the drawings in greater detail, FIG. 1 shows a corner portion of a typical deck and includes a deck assembly 10 with a railing assembly 11 secured to the deck around the outer edges. It will be understood that the deck can be wider and deeper than shown and is preferably supported on suitable posts (not shown) extending into the ground. The deck assembly includes an end rim joist 14 and side joists 15, as well as internal joists, which extend parallel to the end rim joist 14 between the side joists 15 at each end. These outer joists are generally doubled in thickness for additional strength and to provide sufficient thickness of wood for mounting of the railing assembly. The joists define an upper surface on which are secured deck boards 18 with nails or screws in an appropriate manner.

The railing assembly 11 includes parallel, horizontal top and bottom rails 21 and 22 which are connected to corner posts 23 and line posts 24 extending upwardly from the deck. Appropriate balusters or spindles 26 are mounted between the top and bottom rails 21 and 22 in an appropriate manner. If desired, a middle rail can be added, as disclosed in the present inventor's U.S. Pat. No. 5,572,845. The exact construction of the railing is shown by way of example, since the invention is directed to the mounting of the corner and line posts 23 and 24, as described in greater detail hereinafter.

The corner and line posts 23 and 24 are preferably identical in construction and have a square cross-section of a nominal 4×4 inches, or an actual 3½×3½ inches and are provided with a decorative top portion 28 and a bottom or lower end portion 29 formed in identical manner for securing the posts to the deck. The lower end portion 29 is formed with a notch or recess 31 which extends across the end from side-to-side, and has a vertical side 32, and top surface 33. With the 3½×3½ dimensions for the post, the vertical length of the side 32 is made sufficiently long to provide sufficient vertical overlap over the deck boards and rim joists, but should be in the order of 5½ to 6 inches. The depth of the notch, as determined by the length of the top surface 33, is preferably about 1¼ inches. When the post is used as corner post 23, a filler block 36 is placed in this notch to fill the outer part, and therefore, has dimensions of about 1¼×2¼ inches, with a height equal to that of the vertical side 32. When the filler block 36 is positioned within the notch, it therefore leaves a 1¼ inch square open portion to fit over the corner, and this accurately positions the post symmetrically on the corner. Of course, the corner post could be made different from the line post to have only the 1¼ inch notch at the corner so that no filler block is required, but this would require additional expense to cut the square notch, and the post would no longer be interchangeable with the line posts.

The corner post 23 is held in place on the deck by means of a corner bracket 40, as shown in FIGS. 2 and 3, which is shaped to abut the sides of the lower end portion. Bracket 40 is basically symmetrical in shape and can be formed by bending from a flat rectangle of sheet metal, such as steel. At its center point, the bracket 40 has an outer corner 41 from which extend at right angles two outer sides or panels 42 and 43 along the outer sides of the post's lower end 29 and the filler block 36. Each of the sides 42 and 43 terminates in an inward bent edge 44 and 45, from which extend two inner sides or panels 46 and 47 back along the sides of the posts and the filler block to the edges of the notch in the post. At these inner edges are corners 48 and 49 where the bracket has outwardly-extending flanges 50 and 51 which are adapted to abut against the joists at the corner of the deck. As shown in FIG. 3, at the corners, joists may be doubled by providing backing joists 62 for the end joist 14, and a backing joist 63 for the side joist 15.

The corner bracket 40 is secured to the corner post lower end 29 and filler block 36, and is secured to the joists 14 and 15 and backing joists 62 and 63 as a unit by a number of lag screws 61. Positioning and anchoring for the lag screws 61 is provided by a hole or opening 55 in the one outer side 42 located at the mid point, while the other outer side 43 has a pair of vertically-spaced holes or openings 56, and all of these openings are spaced uniformly inward from the outer edges 44 and 45 so that all three lag screws can pass through the filler block 36 and post end portion 29 into the joists through the gap provided between the two corners 48 and 49. The two flanges 50 and 51 are each provided with pairs of openings 57 and 58 which are also vertically-spaced at the mid point of the flanges, and the lag screws 61 are then inserted through pre-drilled holes to form the pattern shown in FIG. 3. With this arrangement, the lag screw passing through the opening 55 bisects the filler block 36 longitudinally and extends into the end of the end rim joist 14, while the lag screws through the openings 56 at right angles extend through the lower end of the corner posts and also into the end rim joist 14 from the side. When lag screws are put through the openings 57 on the flange 50, they are positioned to enter the end of the backing end joist 62, while the lag screws through the openings 58 extend through both the end rim joist 14, its backing joist 62, and endwise, into the backing side joist 63.

With the above arrangement, it can be seen that the seven lag screws 61 are fully embedded in the joists and serve to hold the entire assembly in place, and all of the screws are at least partially anchored in the joists and serve to hold the corner bracket 40 in place as well as the corner post 23. While as shown in FIG. 2, the corner bracket 40 has smooth, parallel top and bottom edges 52, it will be recognized that these may be given a decorative design, if so desired.

Figure 4:
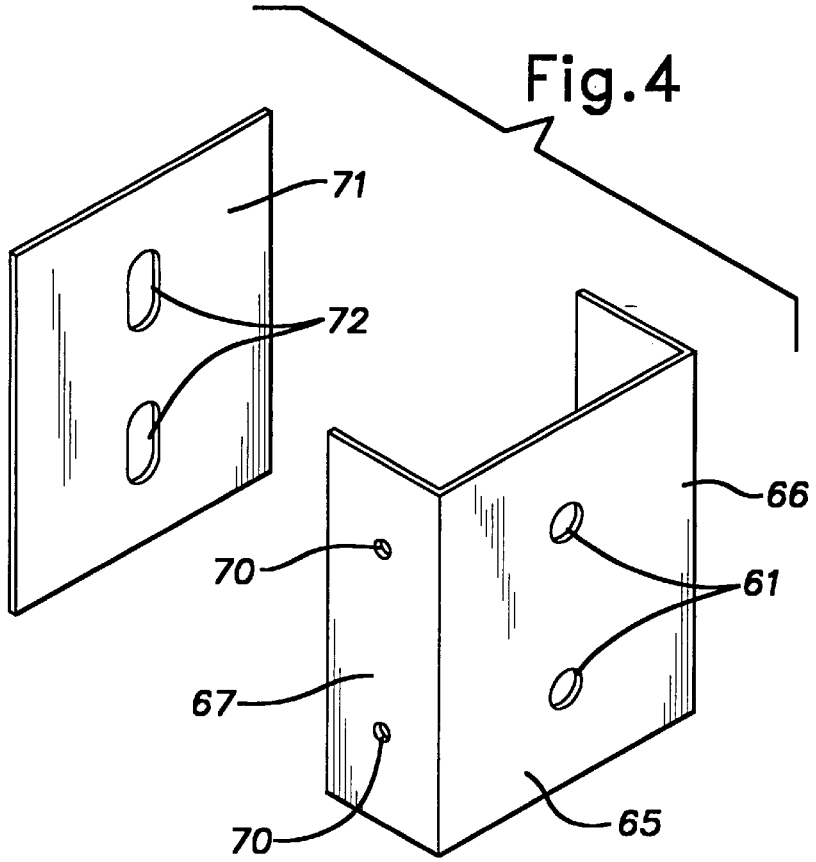
FIG. 4 is a perspective view of a bracket and backing plate for securing a line post to the deck as shown in FIG. 1.
Figure 5:
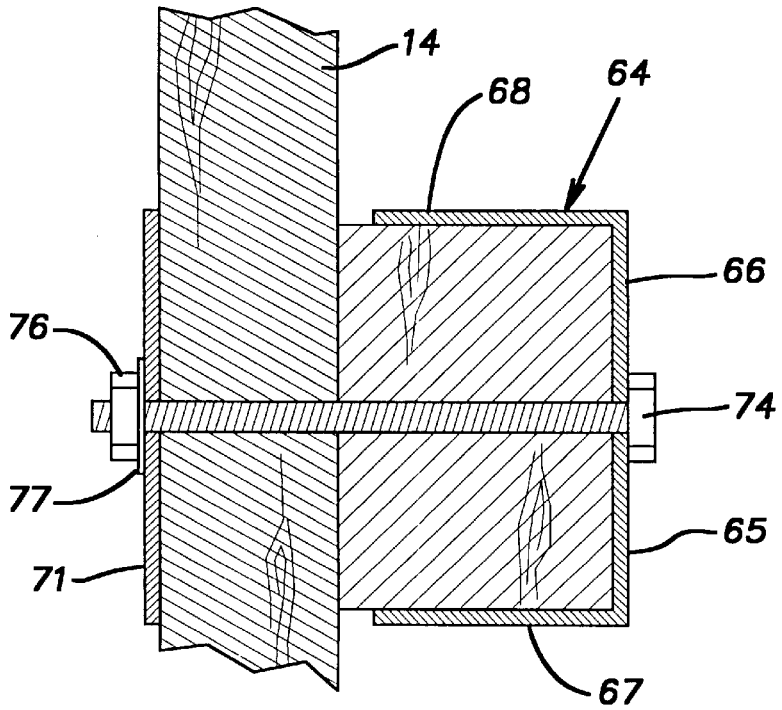
FIG. 5 is a fragmentary cross-sectional view of a line post and brackets secured to a rim joist.

The line posts 24 are mounted to the deck and the rim joist 14 by a line post bracket assembly 64, as shown more clearly in FIGS. 4 and 5. The bracket assembly includes an outer plate 65, which fits over a line post lower end and is generally channel-shaped with a face portion 66 extending parallel to the rim joist, and side flanges 67 and 68 extending toward the rim joist for almost the entire thickness of the lower end 29. Holes 70 are provided in the side flanges 67 to receive suitable nails for tacking the bracket in place on the post. The face 66 is provided with a pair of vertically-spaced openings 69, while a backing plate 71 is placed on the rear side of the rim joist 14 in alignment with the outer plate 65 with openings 72 in alignment with the openings 69. After this is done, holes are drilled through the post lower and the rim joist in alignment with said openings, and machine screws 74 inserted therethrough to engage nuts 76 and washers 77 on the rear side of the backing plate 71. When the screws are tightened, the lower end of the line post is clamped securely to the rim joist and deck to prevent outward movement of the post, while lateral movement is prevented by the presence of two vertically-spaced screws and the engagement of the notch 31 over the deck surface.

The presence of the side flanges 67 and 68 tends to prevent any possibility of the post splitting, while the face 66 and backing plate provide large areas to distribute the clamping force over the adjacent wood surfaces.

With the arrangements of the corner bracket and line post bracket, the posts are secured to the deck with sufficient clamping forces that the full strength of the posts and the rest of the rail assembly can be used without fear that the attachment of the rail assembly to the deck will be broken by impact, and the basic strength of the rail assembly is therefore limited to the rail assembly itself, and not its mode of attachment to the deck and its support structure.

It is recognized that various modifications and rearrangements may be resorted to without departing from the scope of the invention as defined in the claims.

What is claimed is:

1. A corner post assembly on a wood deck having a corner formed by two intersecting rim joists and a deck on top of said rim joists, comprising a post having a bottom end portion, said end portion having vertical side surfaces, a recess in said bottom end portion having a vertical surface and a horizontal surface making abutting engagement with the top of the deck, a unitary sheet metal mounting bracket having a vertical wall extending around and abutting said vertical surfaces of said end portion to the edges of said recess, said bracket having a pair of wall panels extending outwardly from the Outer edges of said wall at said recess and arranged to abut the outer sides of said rim joists, said wall and panels having openings to receive fasteners extending through said wall and panels and said post at right angles and into said rim joists.

2. A corner post assembly as set forth in claim 1, wherein said fasteners are lag screws having heads engaging said bracket and opposite ends embedded in said joists.

3. A corner post assembly on a wood deck having a corner formed by two intersecting rim joists and a deck on top of said rim joists, comprising a rectangular post having a bottom end portion, said end portion having vertical side surfaces, a recess in said bottom end portion having a vertical surface and a horizontal surface making abutting engagement with the top of the deck, a sheet metal mounting bracket having a first pair of panels intersecting at an outer corner and abutting said vertical surfaces of said post, said bracket having a second pair of panels of lesser width than that of said first pair of panels and extending at right angles to the outer edges of said first panels, said second pair of panels extending partially over and abutting the other vertical side surfaces of said bottom end portion to the edges of said recess, said bracket having a third pair of panels extending outwardly from the outer edges of said second panels and parallel to said first panels and arranged to abut the outer sides of said rim joists, said first and third pairs of panels having openings to receive fasteners extending through said panels and into said rim joists.

4. A corner post assembly as set forth in claim 3, wherein said fasteners in said first pairs of panels extend through said post bottom end portion and into said joists and said fasteners in said third pair of panels extend directly into said rim joists.

5. A corner post assembly on a wood deck having a corner formed by two intersecting rim joists comprising a rectangular post having a bottom end portion, said end portion having vertical side surfaces, a recess defined by a vertical surface extending across said bottom portion and a horizontal surface making abutting engagement with the top of the deck, a filler block in said recess abutting a portion of said vertical surface and extending even with the two adjacent vertical side surfaces to fill a portion of said recess, a sheet metal mounting bracket having a first pair of panels intersecting at an outer corner and abutting said vertical surfaces of said post and said filler block, said bracket having a second pair of panels of lesser width than that of said first pair of panels and extending at right angles to the outer edges of said first panels, one of said second panels extending over the other outer side of said filler block, the other of said second panels extending partially over and abutting a vertical side surface of said bottom end portion, said bracket having a third pair of panels extending outwardly from the outer edges of said second panels and parallel to said first panels and arranged to abut the outer sides of said rim joists, said first and third panel having openings to receive fasteners extending through said panels, said post and filler block and into said rim joists.

6. A post mounting assembly for a wood deck having a rim joist and a deck on top of said joist, comprising a rectangular post having a bottom end portion, said end portion having vertical side surfaces, a recess in said bottom end portion defined by a vertical surface extending across said bottom end portion and a horizontal surface above said vertical surface, said surfaces making abutting contact with said deck and said joist, said end portion having an outer face extending parallel to said joist, a sheet metal mounting bracket assembly comprising an outer plate having the form of a channel with the center section abutting said outer face and sides extend back at right angles along the sides of said end portion to a point adjacent said rim joist, said mounting bracket assembly including a backing plate abutting the other side of said rim joist in alignment with said outer plate, said outer plate and said backing plate having at least two aligned openings, said rim joist and said end portion having holes aligned with said openings, and fastening means extending through said openings and said holes to clamp said plates together and clamp said end portion to said rim joist.

* * * * *

UNITED STATES PATENT AND TRADEMARK OFFICE

CERTIFICATE OF CORRECTION

PATENT NO. : 5,771,646

DATED : June 30, 1998

INVENTOR(S) : DeSouza

It is certified that error appears in the above-identified patent and that said Letters Patent is hereby corrected as shown below:

Column 6, claim 6, line 32, delete "for" and insert therefor --on--.

On the face of the patent, in the assignee field, insert --Action Sales & Marketing, Inc., Middleburg Heights, Ohio--.

On the face of the patent, insert --Attorney, Agent, or Firm - Pearne, Gordon, McCoy & Granger LLP--.

Signed and Sealed this

Sixth Day of October, 1998

*Attest:*

*Attesting Officer*

Bruce Lehman

BRUCE LEHMAN

*Commissioner of Patents and Trademarks*